US007494554B1

(12) United States Patent
Donahue et al.

(10) Patent No.: US 7,494,554 B1
(45) **Date of Patent: *Feb. 24, 2009**

(54) METHOD FOR CONTINUOUS MANUFACTURING OF CAST ARTICLES UTILIZING ONE OR MORE FLUIDIZED BEDS FOR HEAT TREATING AND AGING PURPOSES

(75) Inventors: Raymond J. Donahue, Fond du Lac, WI (US); Kevin R. Anderson, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 546 days.

This patent is subject to a terminal disclaimer.

(21) Appl. No.: 10/946,126

(22) Filed: Sep. 21, 2004

Related U.S. Application Data

(63) Continuation-in-part of application No. 10/430,871, filed on May 7, 2003, now Pat. No. 6,957,685.

(51) Int. Cl.
*B22C 9/04* (2006.01)

(52) U.S. Cl. ..... 148/698; 164/34; 164/131; 164/132

(58) Field of Classification Search ..... 148/698; 164/34, 35, 131, 132, 76.1
See application file for complete search history.

(56) References Cited

U.S. PATENT DOCUMENTS 4,854,368 A 8/1989 Vezirian ..... 165/34
5,014,764 A 5/1991 Garat ..... 164/34
5,058,653 A 10/1991 Garat ..... 164/34
5,088,544 A 2/1992 Garat ..... 164/34
5,161,595 A 11/1992 Garat ..... 164/34
5,957,188 A * 9/1999 Crafton ..... 164/5
5,960,851 A 10/1999 Donahue ..... 164/34
6,042,369 A 3/2000 Bergman et al. ..... 432/15
6,921,512 B2 * 7/2005 Doty ..... 420/534

OTHER PUBLICATIONS

"Heat Treatment of Aluminum Casting Alloys for Vacuum Die Casting", Light Metal Age, Schneider and Feikus, 1998.

"Solution Heat Treatment for AlSiMg Foundry Alloys", Liss Pederson, Apr. 1999.

"Short Term Solution Heat Treating—The Industrial Application", Ray Donahue, 2001.

* cited by examiner

*Primary Examiner*—Roy King
*Assistant Examiner*—Janelle Morillo
(74) *Attorney, Agent, or Firm*—Andrus, Sceales, Starke & Sawall, LLP

(57) ABSTRACT

A method for the continuous manufacturing of complex cast articles utilizing one or more fluidized beds for heat treatment and aging purposes is herein disclosed. The inventive method contemplates in-line casting, heat treating, quenching, aging and machining of a complex cast aluminum alloy article, such as an engine block or engine block head. Specific advantages of the heat treatment and aging stops of the method of the present invention are herein disclosed.

24 Claims, 6 Drawing Sheets

16
14
4
6
12
2
24
8
10

FIG. 2
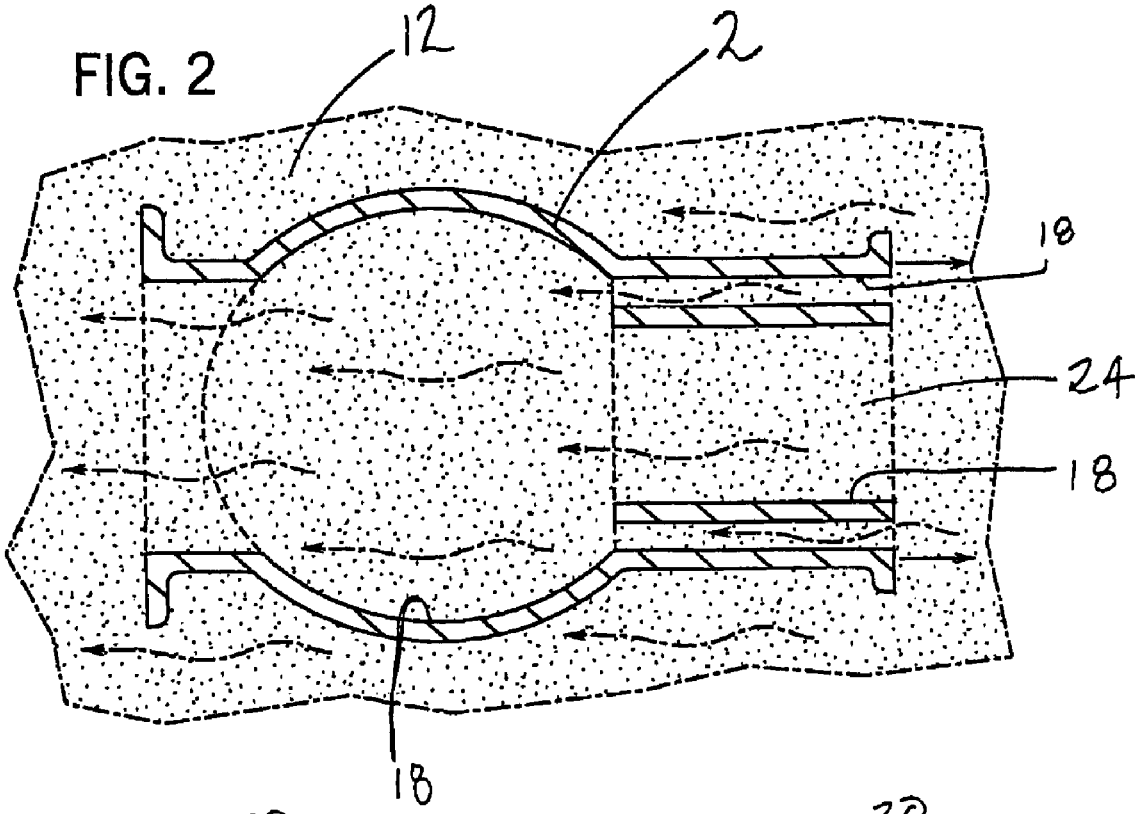
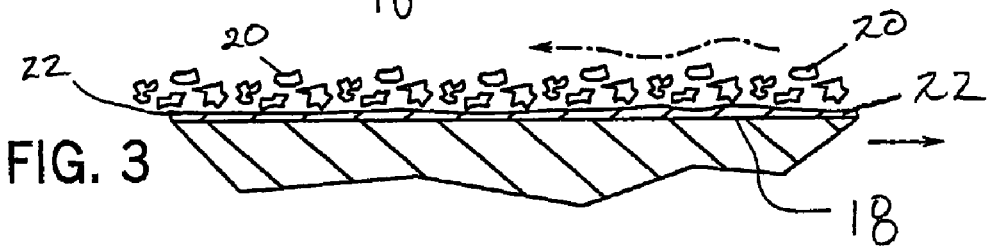
FIG. 3
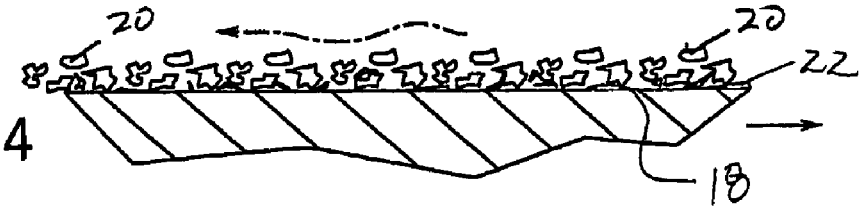
FIG. 4
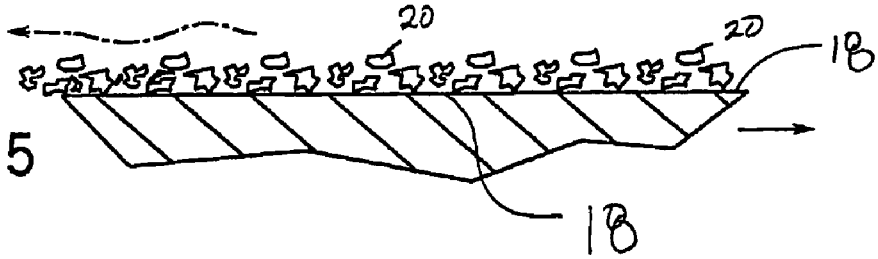
FIG. 5

METHOD FOR CONTINUOUS MANUFACTURING OF CAST ARTICLES UTILIZING ONE OR MORE FLUIDIZED BEDS FOR HEAT TREATING AND AGING PURPOSES

CROSS REFERENCE TO RELATED APPLICATIONS

The present application is a continuation-in-part of U.S. application Ser. No. 10/430,871 filed on May 7, 2003 now U.S. Pat. No. 6,957,685.

BACKGROUND AND SUMMARY OF THE INVENTION

Lost foam and permanent mold casting processes are often utilized to cast complex metal articles, such as engine blocks. It is well documented that the lost foam casting process is an efficient and effective casting process for forming such articles. See U.S. Pat. Nos. 4,854,368; 5,014,764; 5,058,653; 5,088,544; 5,161,595; and 5,960,851. Likewise, permanent mold casting is an effective means for the production of complex metal articles, and is well known in the art of molten metal casting.

One of the advantages of the lost foam casting process is that it is capable of forming complex internal passageways during casting, such as the complex internal passageways of an internal combustion engine. In lost foam casting, a pattern is produced from a polymeric foam material, such as polystyrene, and has a configuration identical to the metal article to be cast. A porous ceramic coating is subsequently applied to the outer surface of the pattern and one or more patterns are placed within an outer vessel. A polymeric foam gating system connects each pattern to a sprue in order to supply the molten metal to the pattern. The space between the patterns and the vessel is filled with a finely divided inert material, such as sand, and the finely divided inert material also fills the internal cavities within the pattern.

In the lost foam casting process, as molten metal is fed into the sprue, the heat of the molten metal acts to decompose or ablate the polymeric foam material comprising the pattern and the gating system. The molten metal occupies the void created by ablation of the foam material, with the decomposition products of the foam passing through the porous ceramic coating of the pattern and becoming trapped within the interstices of the sand. Upon solidification of the molten metal, the resulting cast article has a configuration identical to the original polymeric foam pattern. However, due to the decomposition products becoming trapped within the interstices of the sand, a lost foam cluster or bonded cluster surrounds the cast article after solidification. While there is marginal difficulty in removal of the lost foam cluster surrounding the cast object, there is significant difficulty in removal of the residual ceramic coating from the complex internal passageways of the casting.

For this reason, permanent mold casting is often used instead of lost foam casting for the production of complex cast articles. Permanent mold casting allows for articles to be cast in "dies" that are used time and again for casting articles. While permanent mold casting does not necessitate the intensive clean-up associated with the lost foam casting process, problems arise with cast articles "sticking" to the dies. Further, limits on the complexity of the article to be cast exist, and complex articles are often cast in separate sections using permanent mold casting, which requires later assembly of the sections and may cause variation in the metallographic structure of the separate sections.

A significant thrust of the complex casting industry is directed to the production of engine blocks or engine block heads, particularly, with the advent of aluminum alloy engine blocks having high tensile and yield strengths along with desirable elongation percentages (i.e., heightened ductility). In order to achieve such desirable characteristics in the final cast article, precipitation strengthening of aluminum alloys is performed on the cast articles.

Precipitation strengthening of an aluminum alloy is generally accomplished by a three step process: solution heat treatment, quenching and aging. With most cast articles it is desirable to solution heat treat the articles after they are cast. In general, solution heat treating is the process by which an alloy is elevated to a high temperature, thereby changing its microstructure to improve its properties. Though this thermal treatment, the resulting properties and performance of a component may be manipulated. Specifically, when dealing with aluminum silicon alloys, solution heat treatment changes the alloy's microstructure by spherodizing and coarsening eutectic silicon particles, and homogeneously redistributing precipitate forming elements in solid solution. It is known in the art that the heat-up rate and the time spent at solution heat treatment temperature are important factors in obtaining the properties which will increase performance of a heat treated article.

Quenching refers to the rapid cooling of a cast object. Quenching is traditionally done in water. However, new quenching techniques have been developed where other types of fluids are used for quenching. Quenching momentarily "freezes" the eutectic structure, and renders the alloy workable for a short period of time.

The aging process generally follows quenching to allow for slow precipitation of alloy constituents to create a stronger final structure. In traditional, natural aging, a cast object is held at a low temperature (e.g., room temperature) for an extended period of time to allow for precipitation of constituents. When dealing with aluminum silicon alloys, it is known in the art to place cast objects into an air furnace at a relatively higher temperature (e.g., 250 to 450° F.) for a relatively long period of time (e.g., 4 to 72 hours) after quenching. This traditional aluminum silicon alloy aging process is called artificial aging, and this very practical and popular aging process also allows for the formation of fine strengthening precipitates which creates a stronger final cast article.

The traditional aging process for aluminum silicon alloys, described above, follows thermodynamics and Ahrenious kinetics. Such principles teach that the maximum strength of an alloy is obtained by aging at a lower temperature (thermodynamic consideration) for longer times (kinetics consideration—i.e., slower reaction rates at low temperatures). In a commercial setting, however, this traditional aging method causes a large capital cost and productivity hindrance, as it ties up a substantial amount of furnace capacity during production. Additionally, this traditional aging method uses more energy and would be desirable in order to obtain statistically guaranteed levels of strength in manufactured aluminum alloy parts.

Many attempts have been made in the aluminum industry to create alloys with fine strengthening participates using modified aging processes. Metallurgists have attempted to raise the temperature and/or shorten the time for aging, but such attempts have resulted in a large variability in levels of strength from production lot to production lot. Therefore, the traditional aging methods described above remain commonplace in the industry.

In accordance with the present invention, the use of a fluidized bed has been found to advantageously and economically solution heat treat and age cast aluminum alloy articles. The economy and efficiency of the present invention is achieved through the use of a heated, fluidized bed of an inert material, such as sand, because such beds allow for excellent temperature control which, in turn, provides excellent temperature stability at elevated temperatures. The fluidized beds contemplated for use in conjunction with the present invention is described in U.S. Pat. No. 6,042,369 which is incorporated herein by reference. The fluidized aging bed, as well as the fluidized bed used for quenching, has the same construction as the heat treatment bed 4 and, preferably, is the heated fluidized sand bed described in U.S. Pat. No. 6,042,369. The fluidized beds, as described therein, are very accurate and deviate very little from the desired heat treatment or aging temperature. Thus, one may obtain statistically guaranteed strength in cast articles by heat treating and aging such articles at an elevated, stable temperature for a shorter period of time when compared to conventional solution heat treating and aging processes.

Accordingly, in the aluminum alloy casting industry, the method of the present invention allows one to realize significant production efficiencies while maintaining very high product quality. Specifically, an article may be cast in the morning, solution heat treated around noon, and machined in the afternoon. It is estimated that a minimum of 2 to 4 days of work in process can be eliminated, while quality is improved because the method of the present invention is a continuous process that yields higher statistically guaranteed properties due to excellent temperature control. Thus, the net result is a significant amount of energy savings in conjunction with improved product quality.

A further advantage of the method of the present invention is realized because it has been found that the fluidized action of the beds efficiently and effectively cleans residual ceramic coatings from complex cast articles to a degree that cannot be realized with prior cleaning methods. Even further, it has been found that the lost foam cluster can be directly transferred from the lost foam casting vessel to the fluidized bed to allow for greater economy in the overall casting process.

Therefore, the present invention provides generally for a method of manufacturing a complex aluminum alloy article in a refined time period and further comprises a continuous manufacturing process for engine blocks. The process generally comprises casting a complex aluminum alloy article, solution heat treating the complex article in the first fluidized bed, quenching the complex article, aging the complex article in a second fluidized bed and machining the complex article.

More specifically, the method of the present invention provides for continuous manufacturing of engine blocks and/or engine block heads using the lost foam casting process, wherein the bonded clusters that surround the cast articles resulting from the lost foam casting process are transferred directly into a first fluidized bed. The cast engine blocks and/or engine block heads are solution heat treated in the first fluidized sand bed while, simultaneously, the bonded clusters are removed from around the engine blocks and/or heads and the internal passageways of the engine blocks and/or heads are cleaned. The engine blocks and/or heads are then removed from the first fluidized bed and quenched, preferably in a separate fluidized bed. The quenched engine blocks and/or heads are then transferred to yet another fluidized bed where the engine blocks and/or heads are aged at a desired aging temperature, preferably about 385° F. The engine blocks and/or heads are removed from the aging fluidized bed after a time period from 30 to 60 minutes and are subsequently machined to form a finished product.

One of ordinary skill in the art will realize that this streamlined process provides a multitude of efficiencies in the manufacturing process of complex aluminum alloy articles. Most importantly, production efficiencies are realized through time savings, as well as energy savings, resulting in a more lean manufacturing environment.

BRIEF DESCRIPTION OF THE DRAWINGS

FIG. 2 is a top view of a complex cast metal article moving through a fluidized bed, wherein the metal article is sectioned to demonstrate the flow of fluidized material through the passageways of the article.

FIG. 3 is a magnified view of a side wall of the complex cast metal article demonstrating the presence of a residual ceramic coating and movement of inert material along the side wall.

FIG. 4 is a magnified view of a side wall of a complex cast metal article demonstrating removal of a residual ceramic coating by abrasion of inert material along the side wall.

FIG. 5 is a magnified view of a side wall of a complex cast metal article demonstrating complete removal of any residual ceramic coating by abrasion of inert material along the side wall.

DETAILED DESCRIPTION OF THE PREFERRED EMBODIMENT

The method of the present invention is directed to a process for manufacturing a complex aluminum alloy article in a refined time period and further comprises a novel method for continuous manufacturing of engine blocks and/or engine block heads, as well as a novel method of aging cast aluminum alloy articles.

Figure 1:
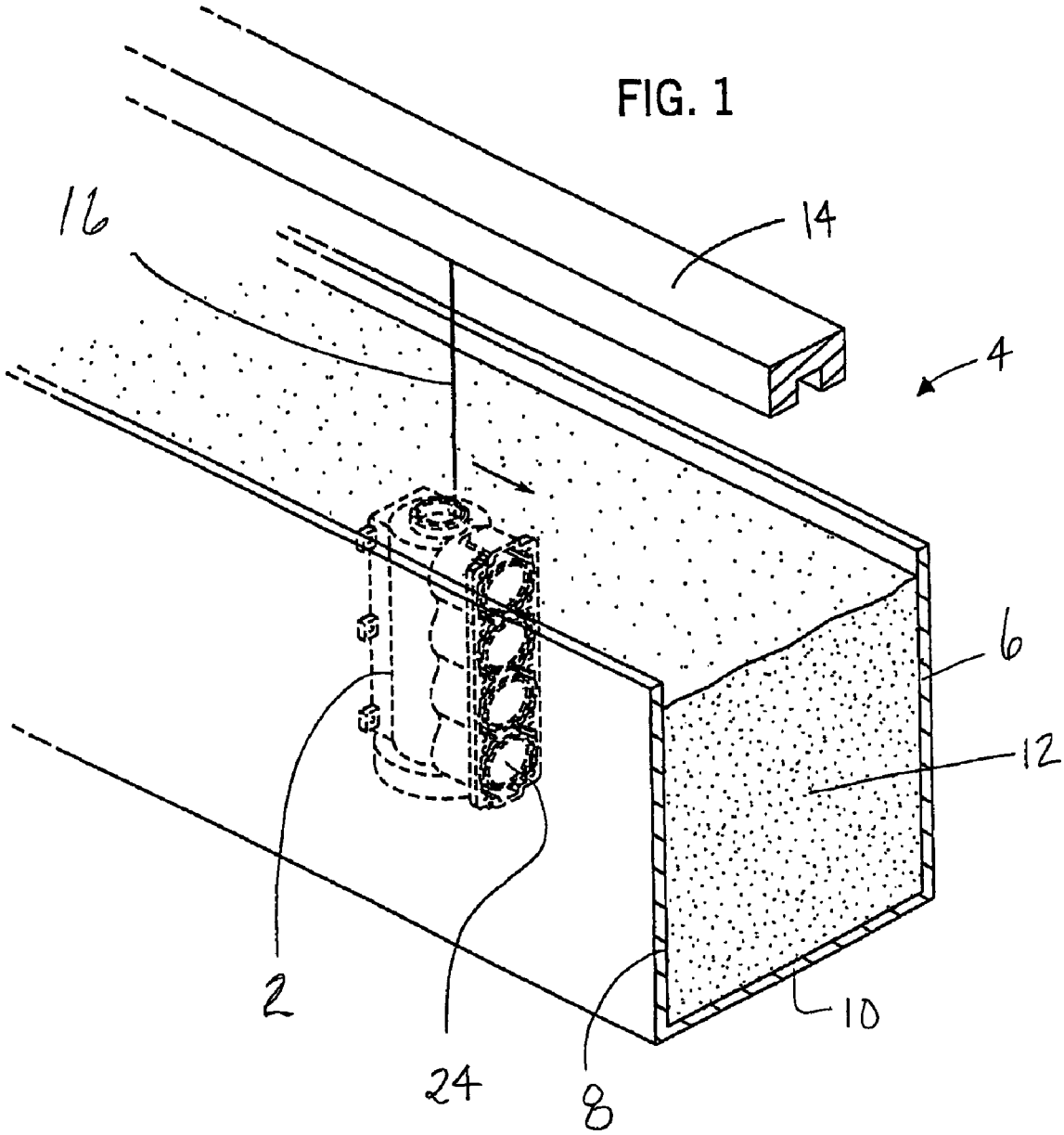
FIG. 1 is a prospective view of a complex cast metal article moving through a fluidized bed.
Figure 6:
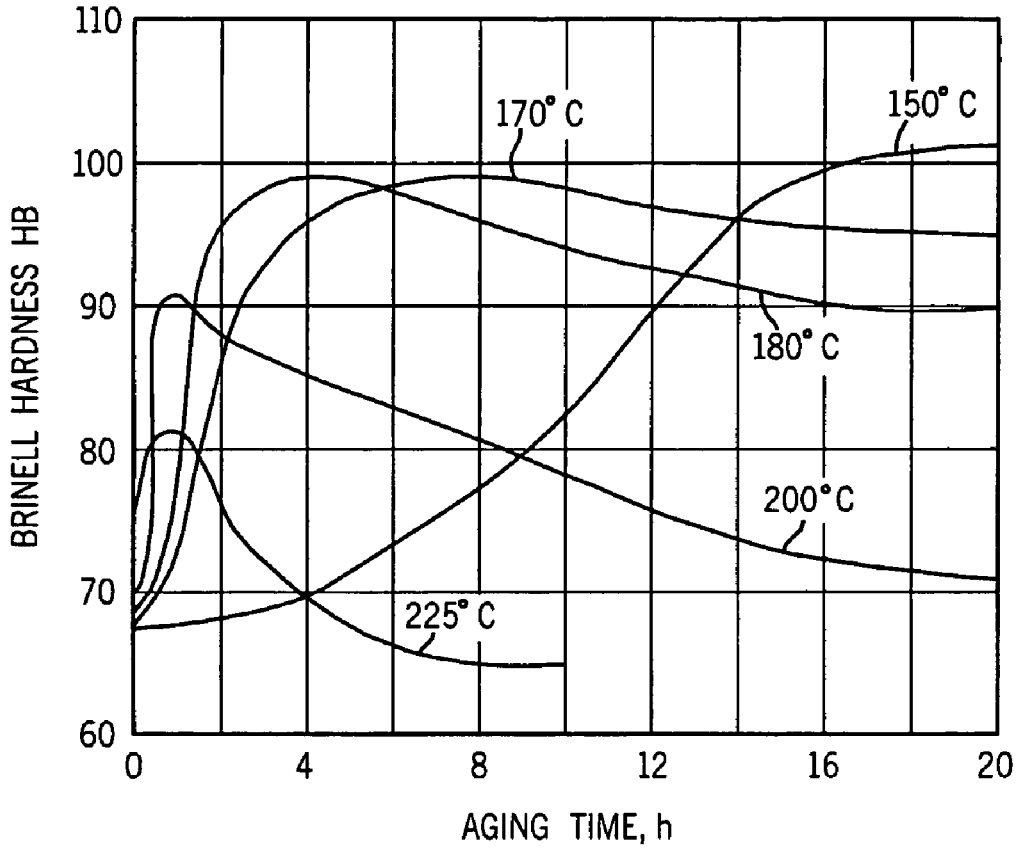
FIG. 6 is a graph demonstrating optimal hardness of aluminum alloys relative to aging time and temperature.

Referring initially to FIG. 1, a complex article 2 is formed by a casting process. Preferably, the casting process is a lost foam casting process, however, permanent mold casting may be used in conjunction with the present invention. The article 2 is metal, such as an aluminum alloy, and is preferably constructed of aluminum silicon alloys from a group consisting of aluminum association alloys 319, 356, 357, 390 or 391. The present invention contemplates use with all aluminum silicon alloys, whether hypoeutectic or hypereutectic. As demonstrated in FIG. 1, the article 2 is preferably an engine block or engine block head.

After the complex article 2 is cast, the article is solution heat treated in a fluidized bed 4. Preferably, the fluidized bed 4 is a heated fluidized bed having a first side wall 6, a second side wall 8 and a bottom 10. The fluidized bed 4 may be filled with many different materials 12. Preferably, the fluidized bed 4 is filled with silica sand. Most preferably, the material 12 is a synthetic media having a tetrahedral shape and belonging to crystal class 4-bar 3M. Alternatively, the material 12 may be angular silica sand, synthetic mullite media having a round shape, or other similar material.

The apparatus utilized in carrying out the method of the present invention further comprises an overhead conveyance mechanism 14 which includes a series of fixtures 16 attached to the overhead conveyance mechanism 14, and further attachable to the complex article 2. The fluidized bed preferably used in conjunction with the present invention is described in U.S. Pat. No. 6,042,369, and is incorporated herein by reference. It will be recognized by one of skill in the art that FIG. 1 generally demonstrates an arrangement for placing a cast article 2 in a fluidized bed 4, and the bed 4 may be used for heat treatment, quenching or aging purposes.

In the preferred embodiment, the complex article 2 is cast using a lost foam casting process. The present invention contemplates transferring the cast article 2 to the fluidized bed 4 from the lost foam casting line, while the part still contains a substantial "heat" enthalpy and before the part has cooled to ambient temperature, for solution heat treatment. Alternatively, the complex article 2 may be transferred from the lost foam casting vessel after it has cooled to ambient temperature. When article 2 is directly transferred from a lost foam casting vessel, a bonded cluster surrounds the cast article 2. The bonded cluster is formed during the lost foam casting process when the ablated foam material, formerly constituting the pattern, enters the interstices of inert material surrounding and supporting the pattern. The ablated polymeric foam material subsequently solidifies in the interstices of the inert material creating a bonded foam cluster around the newly formed article 2.

Referring now to FIGS. 2-5, as the cast article 2 along with the bonded cluster is transferred to the fluidized bed 4, the heat of the fluidized bed 4 acts to decompose the polymeric foam material of the cluster allowing the insert material to be removed from around and within the complex article 2. Importantly, the inert material comprising the foam cluster is incorporated directly into the material 12 of the fluidized sand bed 4. Further, directly submerging the bonded foam cluster into the heated fluidized sand bed 4 results in in situ removal of organic deposits resulting from the lost foam casting process, as well as capturing any emissions trapped within the cluster.

Additionally, as demonstrated in FIGS. 2-5, the material 12 of the fluidized bed 4 thoroughly cleans the walls 18 of complex internal passageways 24 of the complex cast article 2. Thus, as aforementioned, a ceramic coating or residue 22 remaining on the walls 18 of the complex casting 2 from the lost foam casting processes. As the article 2 is moved through the fluidized bed 4, individual particles of material 20 act to remove the ceramic residue 22 from the walls 18 of the complex passageways 24. Although round synthetic media has been found to effectively remove the ceramic coating 22, angular, and particularly, tetrahedral shaped media particles 20 are more efficient in removal of the ceramic residue 22.

As demonstrated in FIGS. 1 and 2, during the step of solution heat treating the complex article, complex article 2 is positioned in a manner such that the complex passageways 24 are positioned in the direction that most benefits the fluid action of the inert material 12 through the passageways 24. Preferably, after the complex article 2 is in the appropriate position, the article 2 is attached to fixture 16 such that fixture 16 holds the complex article 2 in the position that most benefits the fluid action of the material 12 through the passageways 24. In this manner, the fluidized bed 4 transfers heat very quickly to the complex article 2, thereby reducing ramp up time to achieve the desired solution heat treating temperature. This rapid heating is a significant advantage in solution heat treatment of aluminum-silicon alloys as such rapid heating causes the eutectic silicon to spherodize.

The temperature of the fluidized bed varies during the solution heat treating step according to the desired solution heat treatment of the complex article 2. For instance, to solution heat treat a copper-free aluminum silicon alloy, the temperature of the heated fluidized sand bed is above 1000° F., and is preferably 1030° F. However, many articles cast using the lost foam casting process may not withstand such high treatment conditions because they are constructed of alloys having a much lower solidus melting point. Therefore, it is contemplated that the step of solution heat treating the complex article in the present invention comprises solution heat treating the article in the range of 500° F. to 1100° F. The amount of time for the solution heat treatment step is also preferably optimized for ductility, strength and cleaning purposes. Thus, the time for solution heat treatment is dependent upon the metal used, the tortuosity of the complex passageways 24 and the amount of ceramic residue 22 remaining on the walls 18 of the complex passageways 24 from the lost foam casting process. Preferably, the amount of time for solution heat treatment of an aluminum alloy article is a maximum of 60 minutes. However, it has been realized that solution heat treatment for a maximum of 30 minutes is sufficient to provide the solution heat treatment and cleaning advantages of the present invention. Most preferably, the amount of time for solution heat treating a copper-free aluminum silicon alloy engine block is 20 to 30 minutes.

According to the method of the present invention, after the solution heat treatment step is completed, the complex article 2 is transferred from the solution heat treatment fluidized bed for quenching. In the preferred embodiment of the present invention, quenching of the complex article comprises submerging the complex article 2 in a separate fluidized bed, the separate fluidized bed having a temperature in the range of 75° F. to 220° F. Preferably, the separate fluidized bed used for the quenching step is located in-line with the solution heat treatment fluidized bed and a fluidized aging bed. Such arrangement allows for optimization of the continuous process of the method of the present invention. The additional fluidized bed for quenching is preferably configured similarly to the fluidized bed 4 demonstrated in FIGS. 1 and 2.

Alternatively, the complex cast article 2 may be quenched using traditional quenching processes, such as submerging the complex cast article 2 in a fluid, such as water.

After the complex article 2 is quenched, the method of the present invention contemplates aging the complex article 2 in another, in-line fluidized bed 4, or fluidized aging bed. The fluidized aging bed is heated to a desired aging temperature, and the complex article 2 is then submerged in the fluidized aging bed 4, as demonstrated in FIGS. 1 and 2. The complex cast article 2 is maintained in the aging fluidized bed 4 at the desired aging temperature for an optimal time. As demonstrated in FIG. 2, the fluidized action of the bed allows for the material 12 to quickly surround the article 2 providing rapid, stable, uniform application of the aging heat to the article 2. The complex article 2 is then removed from the aging fluidized bed 4.

Preferably, the desired aging temperature is 385° F. plus or minus 2° F. The preferred time for maintaining the cast complex article in the fluidized aging bed is a maximum of 60 minutes, preferably a maximum of 45 minutes, and, most preferably, a maximum of 35 minutes.

Figure 7A:
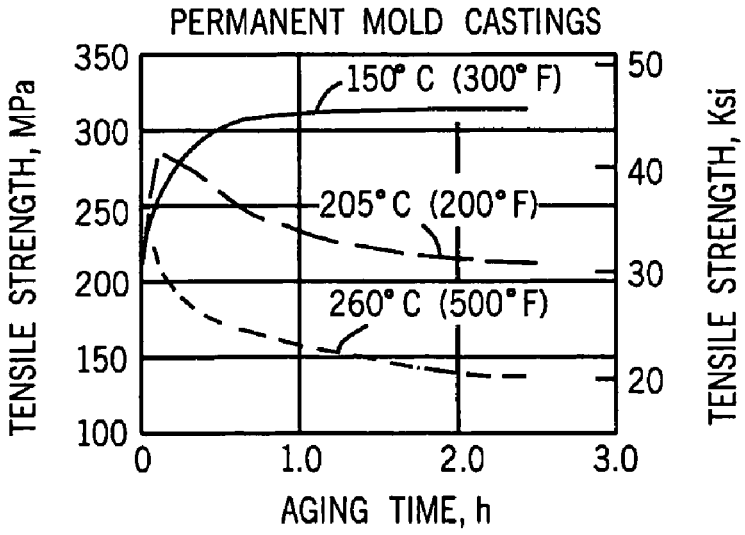
FIGS. 7*a-f* are a series of graphs demonstrating optimal yield tensile strength, elongation % and tensile strength for an aluminum alloy relative to aging time and temperature.
Figure 7B:
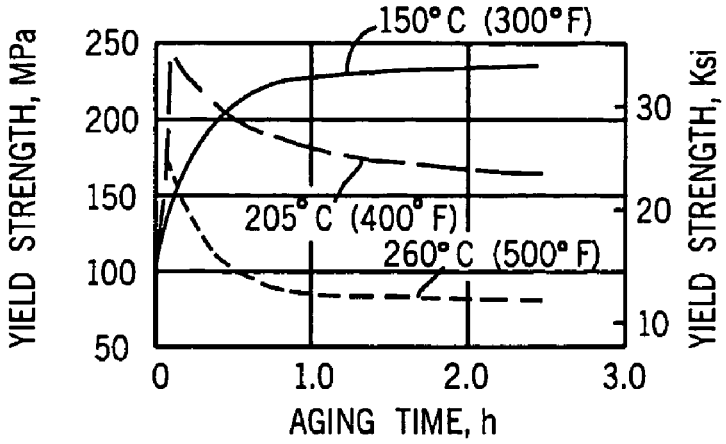
Figure 7C:
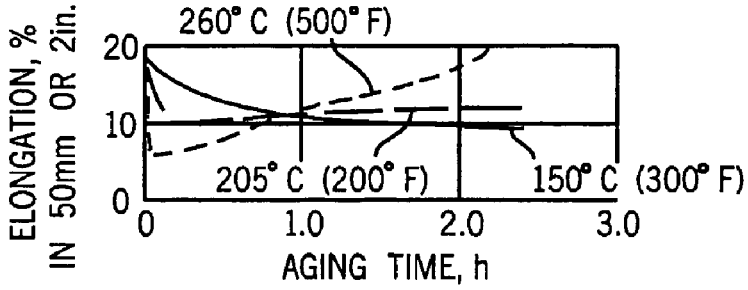
Figure 7D:
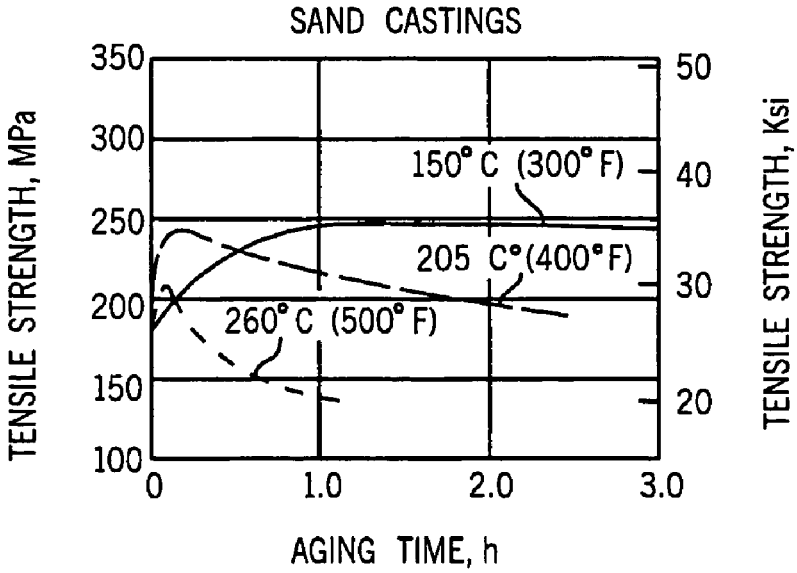
Figure 7E:
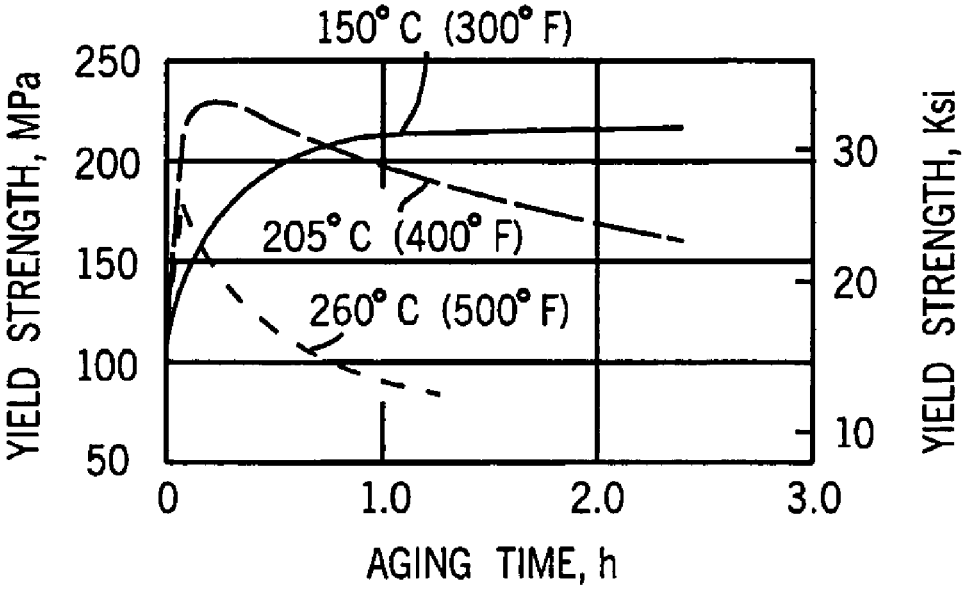
Figure 7F:
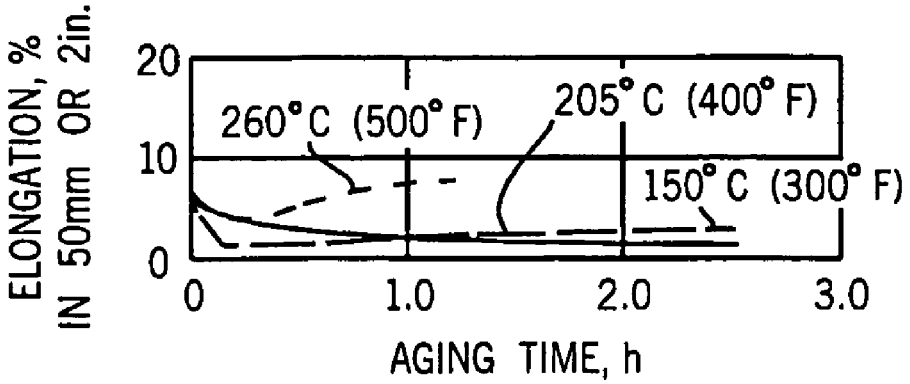

Referring now to FIGS. 6 and 7*a-f*, when the aging process in accordance with the present invention is used, a complex aluminum alloy article 2 may be produced having a more stable microstructure in a shorter period of time than in conventional aging processes. FIGS. 7*a-c* demonstrate the effects of aging time and temperature on tensile strength and elongation percentage for permanent mold castings. Likewise, FIGS. 7*d-f* demonstrate the effects of aging time and temperature on tensile strength, yield strength and elongation percentage for said castings. Metallurgists skilled in the art know that as the aging temperature is increased, the peak tensile strength (i.e., hardness) occurs sooner in time, but as temperatures increase, the peak is smaller. This is clearly illustrated in FIGS. 6 and 7. Thus, conventional aging processes use lower aging temperatures (e.g., approximately 315° F.) and such lower aging temperatures cause the precipitation of fine, relatively smaller size transition precipitates that are responsible for the aging hardening response that significantly increases tensile strength and hardness. Traditionally, higher aging temperatures tend to bypass or eliminate the fine, smaller sized low temperature transition precipitates and tend to form bulky, larger size precipitates that are more stable but do not provide the high tensile strength values obtainable at lower aging temperatures.

Quite unexpectedly, it has been found that aging a complex cast aluminum silicon article 2 in a heated fluidized bed 4 of the type disclosed in U.S. Pat. No. 6,042,369 provides a product that statistically exceeds minimum ultimate tensile strength, yield strength and percent elongation requirements over a very short time period. It is reasoned that such advantages are realized because the rapid heating does not allow dislocation annihilation and thus the rapid heating to the aging temperature produces a different microstructure of precipitates that is responsible for higher strength properties. Thus, the method of the present invention contemplates a fluidized bed 4 to heat the part rapidly and maintain the part at a precise aging temperature between 225° and 450° F., more preferably, at an aging temperature between 375° F. and 400° F. and, most preferably, at an aging temperature of about 385° F. plus or minus 2° F.

Figure 8:
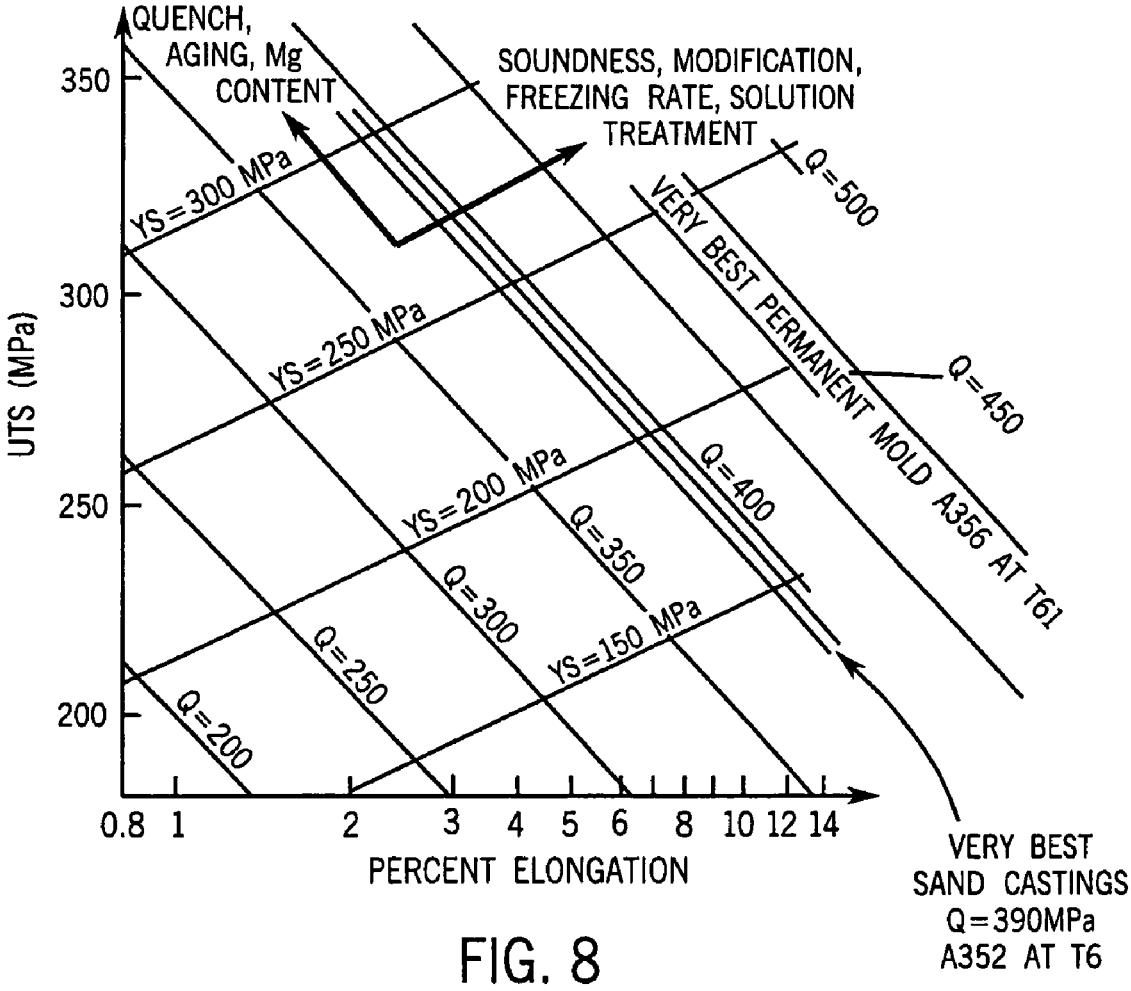
FIG. 8 is a graph demonstrating the relationship between ultimate tensile strength (UTS/hardness), elongation, yield strength and quality index for an aluminum alloy.

Accordingly, it has been found that a complex aluminum alloy article aged in a fluidized bed in accordance with the present invention at about 385° F. plus or minus 2° F. yields a tensile strength (UTS) of 306 MPa (44.4 KSI), a yield strength of 233 MPa (33.8 KSI) and elongation of 11%. Referring to FIG. 8, these results translate into a quality index [Q=UTS+150 log(elongation)] of 462 MPa, which is a very high figure when viewed in light of a quality index graph such as FIG. 8).

After the complex article is appropriately aged, the method of the present invention contemplates removing the article from the aging fluidized bed and machining the complex article to produce a finished article.

The method of the present invention may be applied to achieve continuous and highly efficient production of engine blocks. This embodiment of the present invention contemplates use of a plurality of fluidized beds in-line for the solution heat treatment and aging steps, and preferably uses an additional fluidized bed for the quenching step.

Referring again to FIG. 1, when a plurality of fluidized beds 4 are set up in-line for continuous production of engine blocks 2, it is contemplated that the overhead conveyance mechanism 14 will contain a series of fixtures 16 attached to the engine blocks 2. The plurality of fluidized beds 4 will be located such that the overhead conveyance mechanism can submerge and remove engine blocks 2 from one bed to the next such that there is a continuous in-line process of movement from a casting area, to a solution heat treatment fluidized bed, then to a quenching fluidized bed, subsequent to an aging fluidized bed and finally to a machining area.

The method for continuous manufacturing of engine blocks begins with casting one or more engine blocks using a lost foam casting process. As aforementioned, the cast engine blocks in lost foam casting molds form bonded clusters surrounding the cast engine blocks and filling the internal passageways of the engine blocks after casting. The bonded clusters and cast engine blocks are subsequently transferred to a first fluidized bed for solution heat treatment. The first heated fluidized bed is preferably a heated fluidized sand bed and more preferably is a heated fluidized sand bed comprising an inert material having a tetrahedral shape, and is most preferably a heated fluidized bed containing a synthetic media belonging to the crystal class 4-bar 3M.

After the bonded clusters and engine blocks are transferred from the casting area to the first fluidized bed, the engine blocks are heat treated at above 500° F., preferably between 700 and 1100° F. and, most preferably, at about 1030° F. Simultaneously, the heat and action of the fluidized bed removes the bonded clusters surrounding the engine blocks and cleans the internal passageways of the engine blocks such that the internal passageways of the engine blocks are free from any residual ceramic coating. The engine blocks are then removed from the first heated fluidized bed.

The solution heat treated engine blocks are then quenched. Preferably, the engine block is quenched in a separate fluidized bed at a temperature in the range of 75° F. to 220° F. Most preferably, the quenching temperature of the fluidized bed used for quenching is less than 100° F.

The quenched engine blocks are subsequently transferred to another fluidized bed for aging. The engine blocks are aged in the fluidized bed at a desired aging temperature for a desired period of time. In accordance with the present invention, the desired time is a maximum of 60 minutes, preferably 45 minutes, and most preferably, 40 minutes or less. Likewise, the desired aging temperature is preferably between 325° and 450° F., more preferably, between 350° and 400° F. and, most preferably, at about 385° F.

The engine blocks are subsequently removed from the heated fluidized bed after aging. The engine blocks are then machined to form the final engine block product.

The use of multiple, heated fluidized beds in accordance with the present invention is preferably configured such that the malfunction of one bed does not create a complete shut down of the continuous manufacturing process.

It should be apparent to those skilled in the art that the method of the present invention as described herein contains several features, and that variations to the preferred embodiment disclosed herein may be made which embody only some of the features disclosed herein. For example, it may desirable to utilize the process of the current invention without the heat treatment or quenching features in order to age a cast article. Likewise, it may be desirable to use the process of the current invention without the heat treatment, quenching or aging features in order to effectively clean complex lost foam castings. Even further, it may be desirable to utilize the process of the current invention without quenching or aging steps to T-5 heat treat and clean complex castings.

Various other combinations, and modifications or alternatives may be also apparent to those skilled in the art. Such various alternatives and other embodiments are contemplated as being within the scope of the following claims which particularly point out and distinctly claim the subject matter regarded as the invention.

What is claimed is:

1. A method for continuous manufacturing of engine blocks and engine block heads, wherein said engine blocks and engine block heads comprise engine components that have internal passageways, and wherein a plurality of fluidized beds are utilized, said method comprising:

casting one or more engine components using a lost foam casting process, wherein the cast engine components and lost foam casting molds comprise bonded clusters surrounding the cast engine components and filling the internal passageways of the engine components after casting;

transferring the bonded clusters and engine components to a first heated, fluidized bed;

heat treating the engine components while simultaneously removing the bonded clusters from the engine components and cleaning the internal passageways of the engine components;

removing the engine components from the first heated, fluidized bed;

quenching the engine components;

transferring the quenched engine components to a second heated, fluidized bed;

aging the engine components in a second heated fluidized sand bed at a desired aging temperature;

removing the aged engine components from the second heated, fluidized bed; and machining the engine components;

wherein said continuous method lasts a maximum 8 hours from the beginning of the casting step to the end of the machining step.

2. The method of claim 1, wherein the step of heat treating the engine components while simultaneously removing the bonded clusters from the engine components and cleaning the internal passageways of the engine components further comprises the steps of:

heating the bed to an elevated temperature above 500 degrees F.;

maintaining the engine components in the first heated, fluidized bed for a maximum time of 60 minutes; and providing relative movement between the engine components and material comprising the fluidized bed.

3. The method of claim 2, wherein the material comprising the fluidized bed is sand.

4. The method of claim 2, wherein the material comprising the fluidized bed is an inert material having a tetrahedral shape.

5. The method of claim 2, wherein the material comprising the fluidized bed is an inert material having a round shape.

6. The method of claim 4, wherein the inert material is a synthetic media belonging to the crystal class 4-bar 3M.

7. The method of claim 2 wherein the further step of heating the bed to an elevated temperature comprises heating the bed to an elevated temperature above 1000 degrees F.

8. The method of claim 2 wherein the further step of heating the bed to an elevated temperature comprises heating the bed to an elevated temperature to about 1030 degrees F.

9. The method of claim 2 wherein the further step of maintaining the engine components in the first heated, fluidized bed comprises maintaining the cast engine components in the first heated, fluidized bed for a time period between 30 to 45 minutes.

10. The method of claim 1 wherein the step of quenching the engine components comprises quenching the engine components in a separate fluidized bed.

11. The method of claim 1 wherein the step of quenching the engine components comprises quenching the engine blocks in a separate fluidized bed having a temperature in the range of 75 degrees F. to 220 degrees F.

12. The method of claim 1 wherein the step of aging the engine components in a second heated fluidized sand bed at a desired aging temperature further comprises the steps of:

heating the second fluidized bed to a temperature between 350 and 400 degrees F.;

maintaining the temperature of the second fluidized bed at a preferred aging temperature between 350 and 400 degrees F.; and aging the engine components in the fluidized bed for a maximum of 60 minutes.

13. The method of claim 12, wherein the further step of aging the engine components further comprises aging the engine components in the second fluidized bed for a maximum of 45 minutes.

14. The method of claim 12, wherein the further step of aging the engine components further comprises aging the engine components in the second fluidized bed for a maximum of 30 minutes.

15. The method of claim 1, wherein the step of removing the aged engine components from the second heated, fluidized bed further comprises the engine components having a tensile strength of about 44 KSI, a yield strength of about 34 KSI and an elongation of 11%.

16. The method of claim 1, wherein the step of removing the aged engine components from the second heated, fluidized bed further comprises the engine components having a tensile strength of about 44 KSI, a yield strength of about 34 KSI and an elongation of 11%.

17. The method of claim 12, wherein the step of removing the aged engine components from the second heated, fluidized bed further comprises the engine components having a tensile strength of about 44 KSI, a yield strength of about 34 KSI and an elongation of 11%.

18. The method of claim 1, wherein said continuous method lasts a maximum 6 hours from the beginning of the casting step to the end of the machining step.

19. The method of claim 1, wherein said continuous method lasts a maximum 4 hours from the beginning of the casting step to the end of the machining step.

20. The method of claim 2, wherein said continuous method lasts a maximum 6 hours from the beginning of the casting step to the end of the machining step.

21. The method of claim 2, wherein said continuous method lasts a maximum 4 hours from the beginning of the casting step to the end of the machining step.

22. The method of claim 12, wherein said continuous method lasts a maximum 6 hours from the beginning of the casting step to the end of the machining step.

23. The method of claim 12, wherein said continuous method lasts a maximum 4 hours from the beginning of the casting step to the end of the machining step.

24. The method of claim 12, wherein the temperature is maintained at about 385 degrees F+ or −2 degrees F.

* * * * *